US005542730A

United States Patent [19]

Riesselmann

[11] Patent Number: 5,542,730

[45] Date of Patent: Aug. 6, 1996

[54] FIRE HOSE CARRIER

[76] Inventor: John Riesselmann, 25218-83rd Pl., Salem, Wis. 53168

[21] Appl. No.: 279,553

[22] Filed: Jul. 25, 1994

[51] Int. Cl.[6] ..... B05B 15/06; B65D 63/18

[52] U.S. Cl. ..... 294/157; 239/525; 294/152; 294/165

[58] Field of Search ..... 294/15, 16, 31.2, 294/74, 137, 147, 148–157, 165; 16/114 R; 138/106, 107; 169/51, 52; 239/154, 525; 248/75–78

[56] References Cited

U.S. PATENT DOCUMENTS

| | | | |
|---|---|---|---|
| 209,859 | 12/1878 | Callahan | 239/525 |
| 297,788 | 4/1884 | Green | 294/16 |
| 342,923 | 6/1886 | Munroe | 248/78 |
| 407,118 | 7/1889 | Robinson | 248/76 |
| 448,458 | 3/1891 | Saunders | 248/78 |
| 477,824 | 6/1892 | Robinson | 239/525 |
| 596,689 | 1/1898 | Aungst | 294/16 |
| 622,246 | 4/1899 | Matheas | 294/154 X |
| 633,899 | 9/1899 | Peacock | 248/78 |
| 673,061 | 4/1901 | Prentice | 248/76 |
| 1,275,068 | 8/1918 | Messiter | 248/78 |
| 1,925,431 | 9/1933 | Bishop | 294/153 X |
| 2,508,795 | 5/1950 | Nielsen | 294/152 |
| 2,670,762 | 3/1954 | Stivason et al. | 248/75 X |
| 2,837,120 | 6/1958 | Galloway | 248/76 X |
| 3,942,636 | 3/1976 | Matsuyama et al. | 294/156 X |
| 4,458,933 | 7/1984 | Thomas | 294/31.2 |
| 4,470,177 | 9/1984 | Ganung et al. | 248/76 X |
| 4,754,996 | 7/1988 | Tecca et al. | 294/165 X |
| 4,796,936 | 1/1989 | Sherin | 294/148 |
| 4,804,218 | 2/1989 | Hilliard | 294/157 X |
| 5,348,362 | 9/1994 | Rolls | 294/157 X |

*Primary Examiner*—Johnny D. Cherry
*Attorney, Agent, or Firm*—Jansson & Shupe, Ltd.

[57] ABSTRACT

An improved fire hose carrier which provides greater ease in handling and moving hose, particularly when under pressure, and which is readily attachable and detachable to and from a fire hose is disclosed. The device includes hose-encircling straps with hook and loop layers for quick peel-unpeel securement around the hose, pads secured to the straps to engage the hose, and flexible-band handles secured to the straps.

11 Claims, 2 Drawing Sheets

FIRE HOSE CARRIER

FIELD OF INVENTION

This invention relates to apparatus for carrying and handling fire hose, particularly while under pressure.

BACKGROUND OF THE INVENTION

A standard type of fire hose, when under pressure, is extremely difficult to handle. In use, such hoses are slippery and heavy and do not readily provide an adequate grip to oppose the backward force exerted by the flowing water or to allow moving of the hose. The large circumferences of fire hoses in relation to the human hand contribute further to the difficulty in gripping fire hoses when in use.

Carrying and moving a fire hose to reposition it during use can be a tiring and frustrating experience. Even holding and controlling the hose is difficult; when operating at water pressures of 50–100 pounds, a fire hose may require three men to resist the force generated on the hose by the water pressure. As a result, the nozzleman must use a great deal of energy in the process of adequate hose control.

The need for a solution to this long-standing problem has led to many product development efforts. Some of the many prior hose carrier inventions are those disclosed in the following U.S. Pat. Nos.

4,470,177 (Ganung et al.)

596,689 (Aungest)

633,899 (Peacock)

448,458 (Saunders).

The hose carriers of the prior art have a number of problems and disadvantages which have prevented the wide adoption of hose-attachable hose carrier devices to aid in carrying and moving hose. Some of these disadvantages are due to the fact that the prior art hose carrier devices are made of hard clamps fitted around the hose and/or have one or more hard handles for gripping. Because of the rigid nature of the hard clamps, it may not always be possible to easily maintain a secure hold of the hose. It may also be difficult to attach the devices or adapt the clamps to varying hose diameters.

Hard clamps are also clumsy to carry around for use when necessary. And, they add weight to an already heavy load thereby making the weight the fireman must carry even greater. The clamps of the prior art may also cause the hose to get caught when pulling the hose through debris, around corners, or the like. A hard clamp may also create a hazard if control of the hose is lost and the clamp is allowed to freely swing about with the hose.

There is a clear need for an improved fire hose carrier which can be widely accepted and used in firefighting.

OBJECTS OF THE INVENTION

It is an object of this invention to provide a relatively simple and positive-acting hose carrier which overcomes problems and shortcomings of prior art devices, including those mentioned above.

Another object of this invention is to provide an improved hose carrier providing superior hand-grip capabilities thereby to facilitate the handling of fire hose during use in fire-fighting operations.

Another object of this invention is to provide a fire hose carrier which can be detachably connected to any portion of a fire hose along the length thereof.

Another object of this invention is to provide a fire hose carrier which can be readily adjusted to fit fire hoses of varying diameters.

Still another object of this invention is to provide a hose carrier for attachment along a fire hose which minimizes the chance of any interference when the hose is pulled through debris or around corners or the like.

Another object of this invention is to provide a lightweight means of controlling a fire hose.

How these and other objects are accomplished will become apparent from the following descriptions and drawings.

SUMMARY OF THE INVENTION

This invention overcomes the shortcomings and problems of the prior art by providing a unique hose-carrier device adapted to be readily attachable and detachable to and from a fire hose to facilitate moving and handling the hose when under pressure.

The hose carrier device of this invention includes hose-encircling strap means, means for removably securing the strap means around the hose at selected positions, and flexible-band handle means secured to the hose-encircling strap means. Certain preferred embodiments include a plurality of hose-engaging pad members which are secured to the strap means and most preferably extend along and are spaced equidistantly around and parallel to the hose. This facilitates maintaining position at the selected location of placement along the hose.

In one highly preferred embodiment, the hose-encircling strap means is a pair of straps spaced along the hose. A plurality of pad members to engage the hose are preferably secured to the straps, and extend along and parallel to the hose in circumferentially-spaced positions.

In certain highly preferred embodiments, the flexible-band handle means is a plurality of circumferentially-spaced flexible bands. Each of the bands preferably has two opposite ends attached to the hose-encircling means at positions spaced along the length of the hose. Each of the handle-bands has a first end attached to one of the hose-encircling straps of the pair of straps and a second end attached to the other strap of such pair.

In highly preferred embodiments, the means by which the strap means is removably secured around the hose includes first and second surface fasteners, the first surface fastener being a plurality of hooks layered on one side of a strap means and the second surface fastener being a plurality of loops layered on the other side of the strap means. The first surface fastener and the second surface fastener are secured together when pressed against one another and detached by separating the first surface fastener and the second surface fastener. The material known as "Velcro" is a highly preferred form of loop-and-hooks surface fastener means.

DETAILED DESCRIPTION OF PREFERRED EMBODIMENTS

Figure 1:
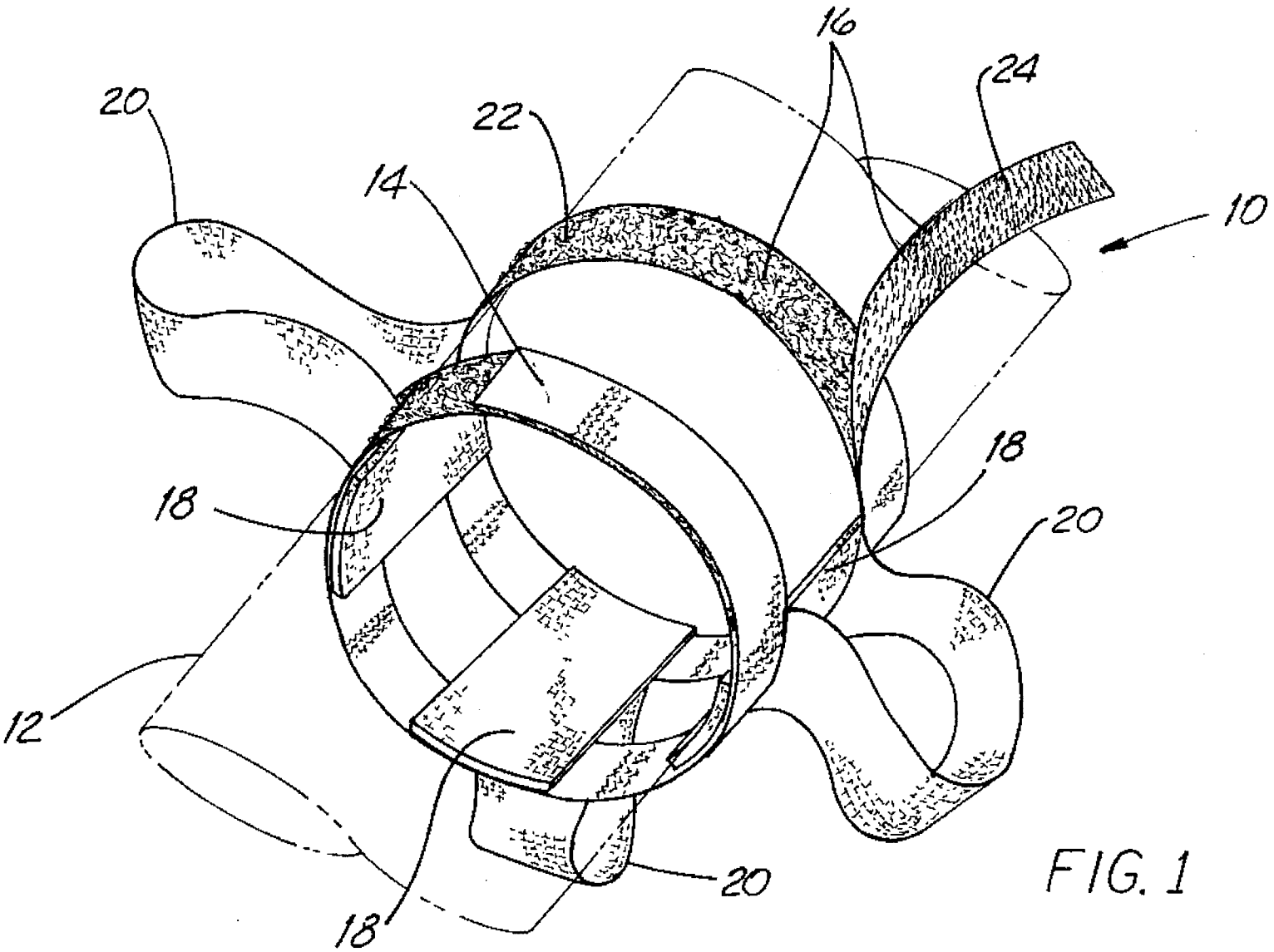
FIG. 1 is a perspective view of a preferred embodiment of a hose carrier in accordance with this invention, shown as attached to a fire hose in use.
Figure 2:
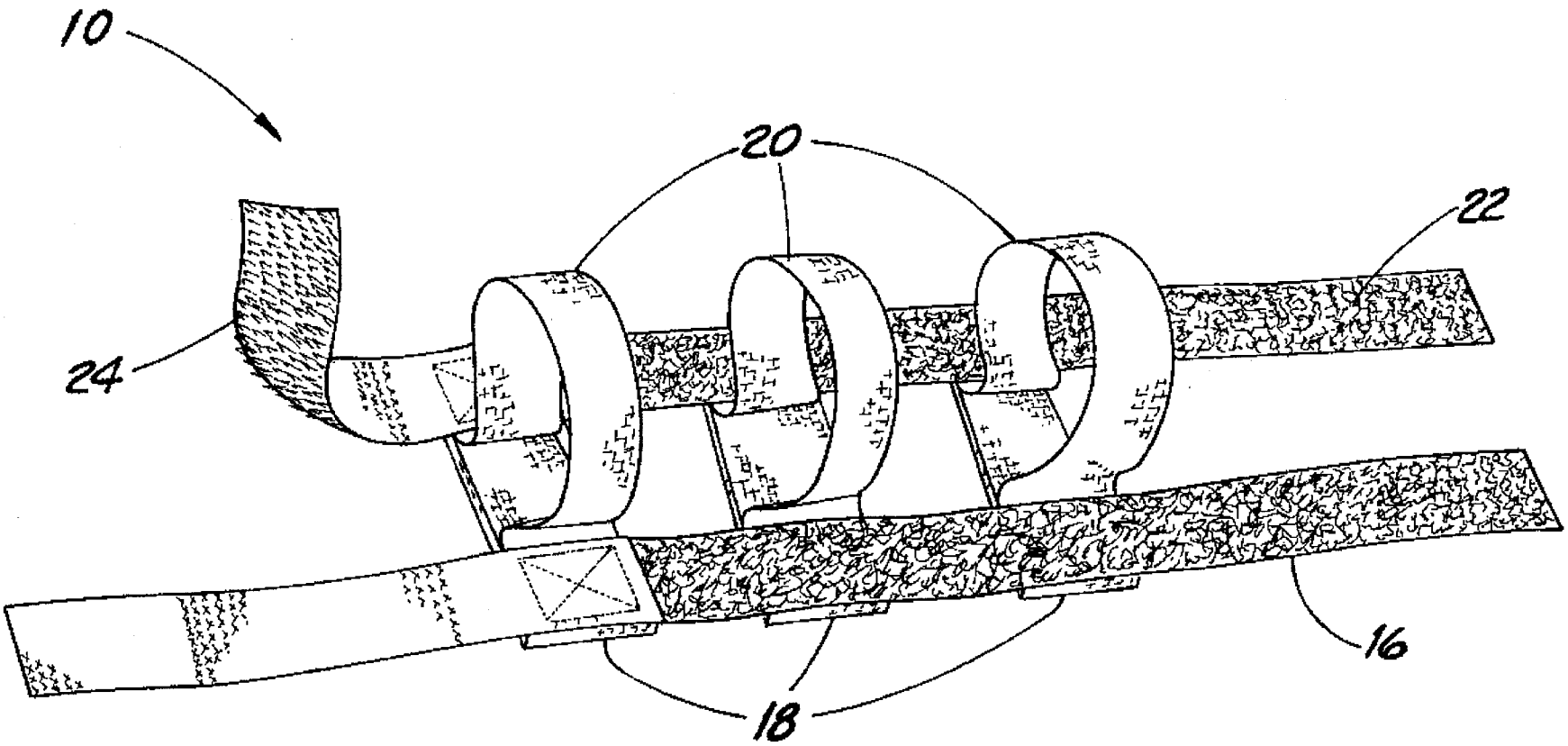
FIG. 2 is a perspective view of the device of FIG. 1, but disengaged from the hose.

The figures illustrate a preferred hose-carrier device 10 which is adapted to be readily attachable/detachable to a fire hose 12 to facilitate moving and handling of hose 12 when under pressure.

Hose-carrier device 10 includes straps 14 for encircling hose 12. Straps 14 and 16 are of a flexible material, preferably of high strength and durability. Suitable materials include a durable synthetic woven fabric, such as nylon, in web-like strips. On the opposite sides, respectively, of opposite ends of each strap 14 and 16, as removably securing means, are first and second surface fastener layers 22 and 24. First surface fastener 22 is a material having on its exposed surface a plurality of hooks; thus, a plurality of hooks is layered on one side of each strap 14 and 16. Second surface fastener 24 is a material having on its exposed surface a plurality of loops; thus, a plurality of loops is layered on the other side of each strap 14 and 16.

Such first and second surface fasteners 22 and 24 are easily secured by pressing the surface fasteners together, and are detached by pulling them apart. As already noted, an example of suitable materials for such hook and loop layering includes "Velcro." Such means for attachment is quick and easy to use.

Pads 18 engage hose 12 and are secured to and extend between the two straps 14. Pads 18 are circumferentially-spaced around hose 12 and extend parallel to hose 12. Flexible-band handles 20 are also secured to strap 14, each handle 20 having opposite ends attached to each of the spaced straps 14.

Pads 18 are preferably of a material with a non-slip surface even when wet. Suitable materials include, but are not limited to, a durable synthetic woven fabric, such as nylon. When hose-carrier device 10 is secured to hose 12 by strap means 14, pads 18 interact with hose 12 to keep device 10 in a constant position along hose 12.

Flexible-band handles 20 are preferably of a material similar to that used for strap means 14. Handles 20 extend along and parallel to hose 12 in circumferentially-spaced positions. Handles 20 provide firefighters with a convenient means of facilitating control of the hose when under pressure.

FIG. 1 illustrates the attachment and detachment to and from a hose 12 of device 10 by securing and releasing first and second surface fasteners 22 and 24. When first surface fastener 22 is pressed together with second surface fastener 24, the plurality of hooks and loops will engage and provide a secure hold on hose 12.

Many variations are possible in the exact design of the fire hose carrier. For example, there may be three or four strap members which encircle the hose. And a variety of methods for securing the straps are possible. In this regard, the term securing means refers to any method by which the straps could be secured.

While the principles of this invention have been described in connection with specific embodiments, it should be understood clearly that these descriptions are made only by way of example and are not intended to limit the scope of the invention.

I claim:

1. The combination of a hose-carrier and hose, wherein the hose-carrier is adapted to be readily attachable/detachable to the hose to facilitate moving and handling the hose when the hose is filled with water and is under pressure, comprising:

a single length of hose;

flexible strap means encircling the circumference of the single length of hose;

a plurality of hose-engaging pad members secured to the strap means;

means for removably securing said strap means around the hose; and flexible-band handle means secured to the flexible strap means.

2. The combination of claim 1 wherein the pad members extend along and parallel to the hose in circumferentially-spaced positions.

3. The combination of claim 1 wherein the hose-encircling strap means comprises a pair of straps spaced along the hose.

4. The combination of claim 3 wherein the pad members extend along and parallel to the hose in circumferentially-spaced positions.

5. The combination of claim 1 wherein the handle means comprises a plurality of circumferentially-spaced flexible bands.

6. The combination of claim 5 wherein each of the bands has two opposite ends attached to the hose-encircling means at positions spaced along the hose,

7. The combination of claim 5 wherein the hose-encircling strap means comprises a pair of straps spaced along the hose,

8. The combination of claim 7 wherein each of the bands has a first end attached to one strap of the pair of straps and a second end attached to the other strap of such pair of straps.

9. The combination of claim 8 wherein the pad members extend along and parallel to the hose in circumferentially-spaced positions.

10. The combination of claim 1 wherein the removable securing means comprises first and second surface fasteners, the first surface fastener being a plurality of hooks layered on one side of a strap means and the second surface fastener being a plurality of loops layered on the other side of the strap means.

11. The combination of claim 10 wherein the first surface fastener and the second surface fastener are secured when pressed against one another and detached by separating the first surface fastener and the second surface fastener.

* * * * *